US006195115B1

(12) United States Patent
Yamaguchi

(10) Patent No.: US 6,195,115 B1
(45) Date of Patent: Feb. 27, 2001

(54) COLOR PRINTER AND EXPOSURE HEAD THEREFOR

(75) Inventor: Akira Yamaguchi, Kanagawa-ken (JP)

(73) Assignee: Fuji Photo Film Co., Ltd., Kanagawa-ken (JP)

( * ) Notice: Subject to any disclaimer, the term of this patent is extended or adjusted under 35 U.S.C. 154(b) by 0 days.

(21) Appl. No.: 09/310,979

(22) Filed: May 13, 1999

(30) Foreign Application Priority Data

May 13, 1998 (JP) ..... 10-129792

(51) Int. Cl.[7] ..... B41J 2/45; B41J 2/435; B41J 2/47

(52) U.S. Cl. ..... 347/238; 347/237

(58) Field of Search ..... 347/238, 240, 347/237

(56) References Cited

U.S. PATENT DOCUMENTS

| | | | | |
|---|---|---|---|---|
| 4,270,149 | * | 5/1981 | Ohta et al. | 358/293 |
| 5,424,560 | * | 6/1995 | Norman et al. | 257/40 |
| 5,936,657 | * | 8/1999 | Fork | 347/237 |
| 6,072,517 | * | 6/2000 | Fork et al. | 347/237 |
| 6,133,933 | * | 10/2000 | Paoli | 347/238 |

OTHER PUBLICATIONS

"Organic EL Development Strategy", Next Generation Display Device Research Group, Science Forum Publishers, 1992.

"Consideration of Achievement and Implementation Strategy of Organic EL", Proceedings of Organic EL Electronics Material Meeting at Hotel Tenbo, Ikaho Hot Spring, Gunma Pref., Japan, 1995.

* cited by examiner

*Primary Examiner*—Thinh Nguyen
(74) *Attorney, Agent, or Firm*—Sughrue, Mion, Zinn, Macpeak & Seas, PLLC

(57) ABSTRACT

Compact and inexpensive color printers can be manufactured. An exposure head using linearly-aligned organic EL elements each composed of subpixels each emitting light of R, G, and B is used as a light source. Input color image data are dealt with as color data corresponding to each of the color components R, G, and B. For each color data, each of the organic EL elements is caused to emit light in accordance with line data for one line corresponding to all organic EL elements composing the exposure head, and a photosensitive material is exposed to the light. After completion of the exposure, vertical scan means moves the photosensitive material by a predetermined amount in the vertical scan direction and the photosensitive material is exposed in accordance with image data corresponding to a subsequent line, as has been described above. By repeating this procedure, exposure corresponding to all image data is carried out.

3 Claims, 3 Drawing Sheets

COLOR PRINTER AND EXPOSURE HEAD THEREFOR

BACKGROUND OF THE INVENTION

1. Field of the Invention

The present invention relates to a color printer and an exposure head therefor. More specifically, the present invention relates to an exposure head and a printer for obtaining color prints by exposing color photosensitive material to color light.

2. Description of the Related Art

Color printers for obtaining color prints by 2-dimensionally scanning color photosensitive material by laser beams of 3 colors namely R (Red), G (Green) and B (Blue) have been known.

This 2-dimensional scan by each of the RGB-color laser beams in such color printers is carried out by deflecting the laser beams with a photodeflector such as a rotational polygon mirror to cause the beams to scan the material in the main scan direction while moving the photosensitive material relative to the laser beams in the vertical scan direction approximately orthogonal to the main scan direction.

In the scanning method in such conventional color printers for obtaining color prints by the 2-dimensional scan with the 3-color laser beams deflected by the rotational polygon mirror or the like, a laser beam source for emitting the beams is necessary. Since the laser beam sources are expensive, color printers using them are also expensive. Furthermore, since the laser beam scanning optical systems are large, color printers using them are also large. Moreover, they have difficulty with respect to registration of the RGB-color laser beams on the photosensitive material.

SUMMARY OF THE INVENTION

The present invention has been created based on consideration of the above problems. An object of the present invention is to provide an exposure head for a color printer enabling size reduction and cost reduction of the color printer and to provide a color printer using such an exposure head.

An exposure head of the present invention is used to obtain a color print by exposing a color photosensitive material to color light and comprises linearly-aligned organic EL(electro-luminescent) elements each representing a pixel of a color image and composed of a combination of a plurality of organic EL's each emitting different color light.

In other words, the exposure head of the present invention comprises the organic EL elements each representing a pixel of a color image and composed of the plurality of organic EL's (subpixels) emitting light of R, G or B respectively, for example.

It is preferable for the organic EL elements composing the exposure head to be formed integrally on one substrate by using a semiconductor technique.

A color printer of the present invention comprises the exposure head described above for exposing the color photosensitive material and a driver for causing each of the organic EL elements to emit light in accordance with input color image information, and vertical scan means for moving the color photosensitive material relative to the exposure head in the vertical scan direction.

The exposure head of the present invention is formed by aligning the organic EL elements. Therefore, a light source for a printer which is smaller and less expensive than a laser beam source can be provided. Furthermore, if organic EL's having stronger luminance are used, an exposure head having higher efficiency can be composed. Moreover, when the exposure head is manufactured, if the organic EL elements are integrally formed on one substrate by using a semiconductor technique, an exposure head having high resolution of more than 1200 dpi, for example, can be manufactured easily.

Therefore, by using this exposure head in the color printer, it becomes possible to produce color printers that are smaller and less expensive than those using conventional laser beam sources. If high-luminance organic EL's are used for the exposure head, high speed printers can be manufactured.

DESCRIPTION OF THE PREFERRED EMBODIMENT

Figure 1:
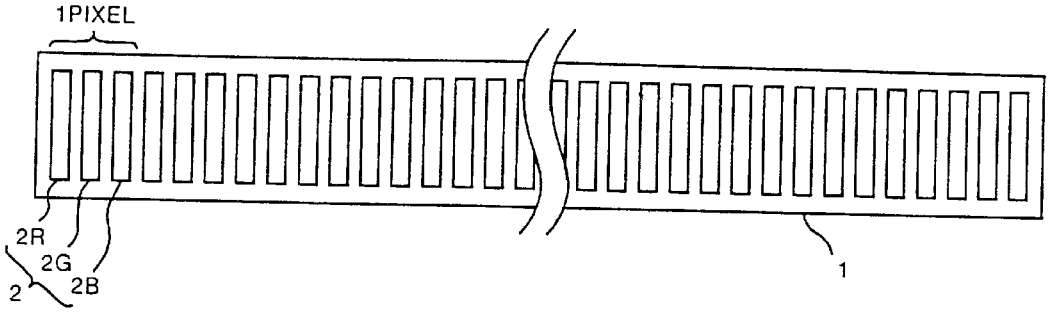
FIG. 1 is a diagram showing a surface of an exposure head of a color printer of the present invention.

Hereinafter, an embodiment of the present invention will be explained with reference to the accompanying drawings. FIG. 1 is a diagram showing a surface of an exposure head 1 as the embodiment of the present invention.

As shown in FIG. 1, the exposure head is formed by organic EL elements 2 aligned linearly. Each of the organic EL elements 2 representing a pixel of a color image is composed of subpixels 2R, 2G, and 2B emitting light of R, G, and B respectively. The exposure head 1 can be formed by linearly aligning each pixel formed separately. However, in this example, the exposure head is formed by the organic EL elements unified on one substrate by using a semiconductor technique. In this manner, the exposure head 1 attains the resolution of 1200 dpi.

A thin film stacking structure of the subpixels 2R, 2G, and 2B emitting light of R, G and B respectively and forming each of the organic EL elements 2 used in the present invention is not explained here. As a method of constructing the thin film stacking structure, various known methods can be used. As a method of manufacturing the high luminance organic EL elements, methods proposed in "Next Generation Display Device Research Group, 1992, Organic EL Development Strategy, Science Forum Publishers" or "Proceedings of Organic EL Electronics Material Meeting, Consideration of Achievement and Implementation Strategy of Organic EL, at Hotel Tenbo, Ikaho Hot Spring, Gunma Pref. Japan, 1995" can be used, for example. For the exposure head of the present invention, not only the methods described in these reference materials but also various methods having been proposed regarding a structure of an organic EL element can be adopted.

Figure 2:
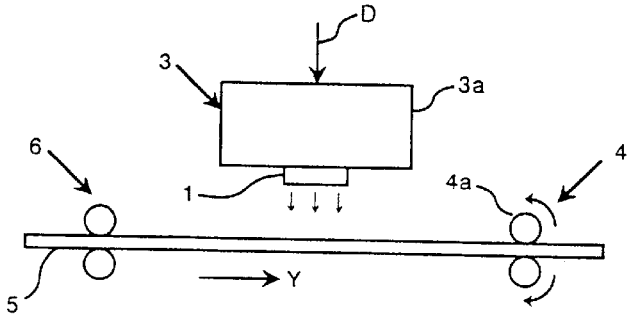
FIG. 2 is an outline side view of the color printer using the exposure head.

FIG. 2 is a side view showing an outline configuration of a color printer 6 using the above-described exposure head 1. The color printer 6 comprises a head unit 3 including the exposure head 1 for exposing a color photosensitive material 5 and a driver 3*a* unified with the exposure head 1 for causing each of the organic EL elements 2 to emit light in accordance with color image data D input therein, and vertical scan means 4 including four rollers 4*a* for conveying the photosensitive material 5 in a vertical scan direction Y while nipping the material 5. The rollers 4*a* are forced to rotate in a direction such that the photosensitive material 5 is conveyed in the vertical scan direction Y, by a motor which is not shown in FIG. 2.

The vertical scan means 4 is not limited to the above example. Any means which can move the photosensitive material 5 relative to the head unit 3, that is, move the exposure head 1 in the vertical scan direction Y, may be adopted.

Figure 3:
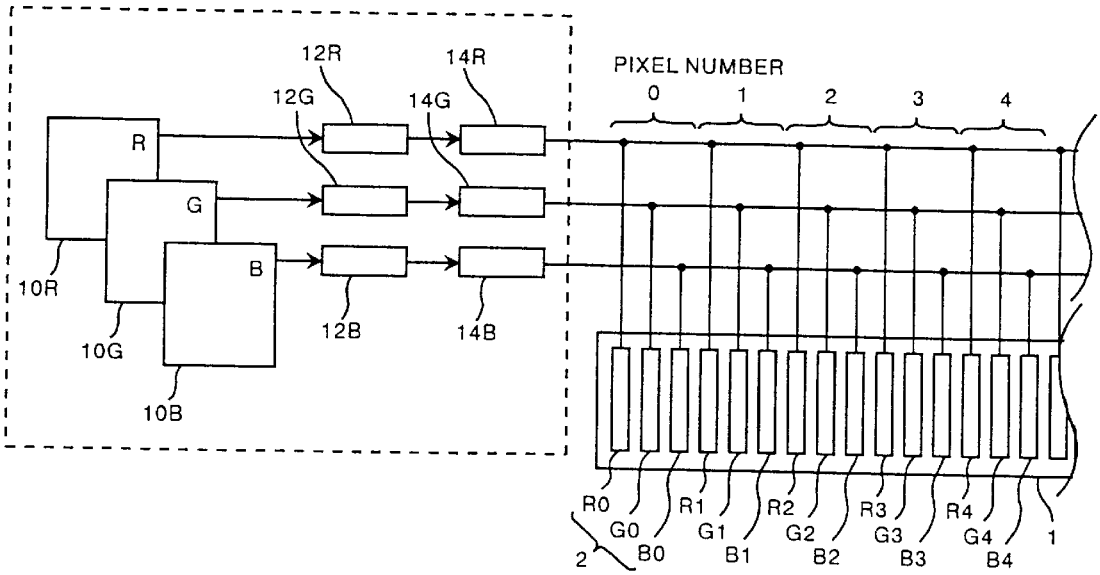
FIG. 3 is a circuit block diagram showing a head unit composing the color printer.

FIG. 3 is a circuit block diagram showing the head unit 3. The input image data D are stored temporarily in frame memories 10R, 10G, and 10B of the driver 3*a* as frame data DF respectively corresponding to the colors R, G and B. Image data corresponding to all organic EL elements 2 composing the exposure head 1 are read from the frame memories 10R, 10G and 10B to line memories 12R, 12G, and 12B respectively. The image data input to the line memories 12R, 12G, and 12B are image data (line data) DL corresponding to one line of the main scan. The line data DL in the line memories 12R, 12G and 12B are respectively input to drive circuits 14R, 14G, and 14B.

Figure 4:
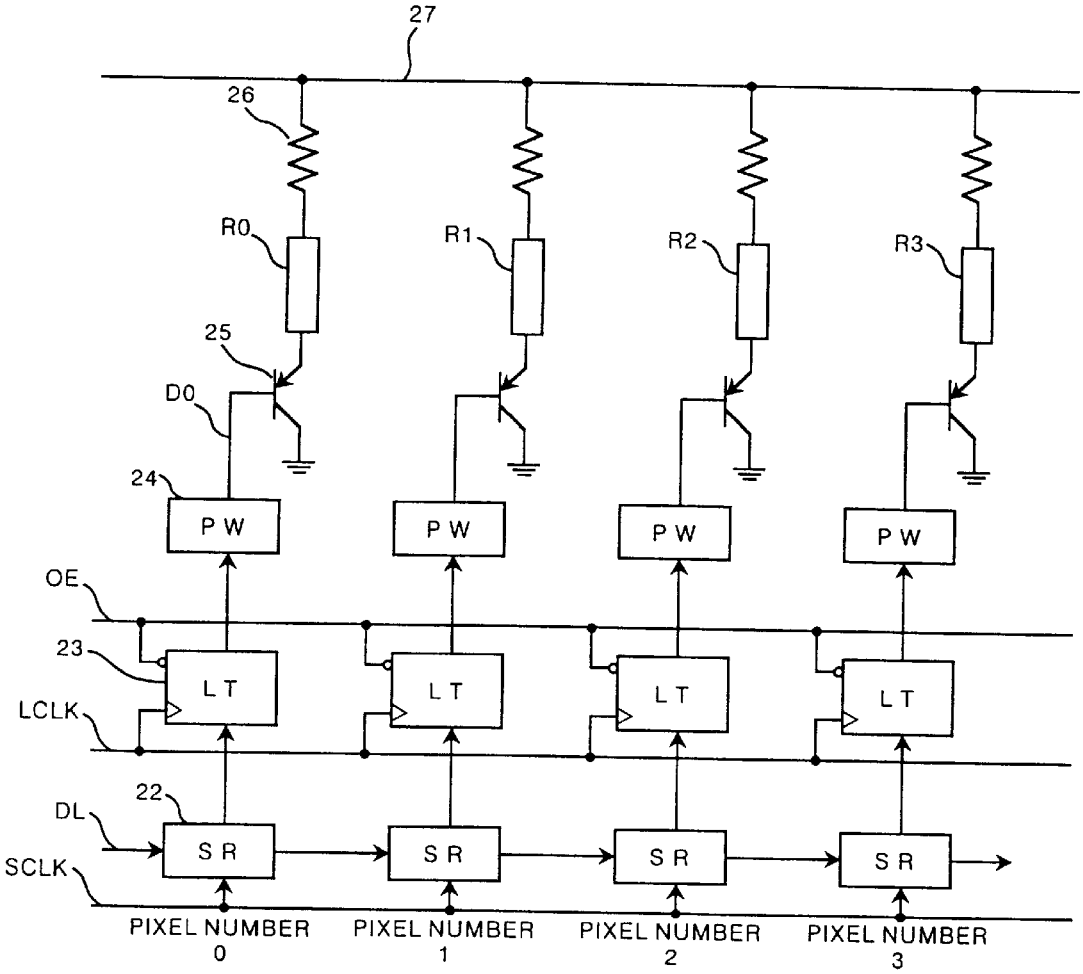
FIG. 4 is a circuit diagram showing in detail a drive circuit composing the head unit.

An example of the drive circuit is shown in FIG. 4, regarding the drive circuit 14R. The input line data are 8-bit data. The line data DL are first input to a shift register (SR) 22 corresponding to the pixel number 0. Each time a shift clock SCLK is input, the line data are sequentially transferred to a subsequent shift register. In this manner, the image data corresponding to one line end up being stored in every shift register corresponding to all organic EL elements 2 composing the exposure head 1.

After completion of storage of the line data DL, a latch clock LCLK is input to each of latches (LT) 23, and the line data DL are stored in the latches 23 each connected to each shift register 22. An output enable signal OE is then input to the latches 23 and the line data DL stored in each of the latches are input to each pulse width controlling circuit (PW) 24.

The pulse width controlling circuit 24 converts the input 8-bit line data DL into a signal which represents the line data DL by its pulse width. The converted image signal D0 is input to the base of a drive transistor 25 whose collector is grounded. One terminal of each of the organic EL elements (in this example, R0, R1, R2, and R3 for each pixel) is connected to the emitter of each of the drive transistors 25. The other terminal of each of the organic EL elements R0, R1, R2 and R3 is connected to a power supply line 27 via a resistor 26 for setting an operating point. Therefore, each of the organic EL elements R0, R1, R2, and R3 emits light in accordance with the pulse width. In this manner, the exposure of the photosensitive material 5 (see FIG. 2) is controlled in response to the line data Dl, that is, in response to the image data DF. As the drive transistor 25, a known drive IC for a thermal head can be used.

Once the exposure for one line has been completed in this manner, the vertical scan means 4 (FIG. 1) moves the photosensitive material 5 by a predetermined amount in the vertical scan direction Y. The image data DL corresponding to a subsequent line are read from the frame memories 10R, 10G, and 10B to the line memories 12R, 12G, and 12B respectively, as has been described above. The above-described exposure is then carried out sequentially and exposure corresponding to all the image data D is finished. In this manner, the exposure of one sheet of the photosensitive material 5 is completed.

As has been described above, if a color printer is manufactured by using the exposure head composed of linearly-aligned organic EL elements each composed of subpixels each emitting light of a different color, it is not necessary to use a conventional large optical scanning apparatus for its main scan optical system. Therefore, very small and inexpensive printers can be manufactured. Moreover, if the organic EL elements can emit light of high luminance, high speed printing can be carried out.

What is claimed is:

1. An exposure head for obtaining a color print by exposing a color photosensitive material to light, the exposure head comprising:

linearly-aligned organic EL elements each representing a pixel of a color image and comprising a combination of a plurality of organic EL's each emitting different color light; and a drive circuit comprising:

pulse width controlling circuits for converting input line data into a signal that represents said line data by a pulse width of said line data; and resistors, connected to said organic EL elements, for setting an operating point.

2. An exposure head as claimed in claim 1, wherein the organic EL elements are integrally formed on one substrate by using a semiconductor technique.

3. A color printer comprising the exposure head as claimed in claim 1 or 2 for exposing a color photosensitive material;

a driver for causing each of the organic EL elements to emit light in accordance with input color image information; and vertical scan means for moving the color photosensitive material relative to the exposure head in a vertical scan direction.

* * * * *